United States Patent [19]

Scherer

[11] 4,161,939

[45] Jul. 24, 1979

[54] OVEN LINER SUSPENSION ASSEMBLY

[75] Inventor: Richard M. Scherer, Oxford, Miss.

[73] Assignee: Chambers Corporation, Oxford, Miss.

[21] Appl. No.: 883,748

[22] Filed: Mar. 6, 1978

[51] Int. Cl.[2] ..... F24C 15/16

[52] U.S. Cl. ..... 126/19 R; 126/39 M; 126/273 R

[58] Field of Search ..... 126/19 R, 39 M, 273 R; 219/392

[56] References Cited

U.S. PATENT DOCUMENTS

| | | | |
|---|---|---|---|
| 574,799 | 1/1897 | Graves | 126/39 M |
| 2,116,669 | 5/1938 | Dadson | 126/273 R |
| 2,555,841 | 6/1951 | Clark | 126/19 R |
| 3,038,462 | 6/1962 | Hurko | 126/19 R |
| 3,120,224 | 2/1964 | Divelbiss | 126/39 M |
| 3,131,684 | 5/1964 | More et al. | 126/19 R |
| 3,385,280 | 5/1968 | Schmahl | 126/19 R |
| 3,706,302 | 12/1972 | Helgeson | 126/19 R |

*Primary Examiner*—Carroll B. Dority, Jr.
*Assistant Examiner*—Daniel J. O'Connor
*Attorney, Agent, or Firm*—Richards, Harris & Medlock

[57] ABSTRACT

The specification discloses an oven liner suspension assembly for rigidly suspending an oven liner, while allowing for expansion and contraction of the oven liner undergoing heating and cooling during cooking and self-cleaning operations. A pair of elongated anchor legs is secured to the rear portion of the oven liner, and each anchor leg extends a predetermined distance beyond the bottom wall of the oven liner. An L-shaped base member of each anchor leg is rigidly secured to a main base plate of the frame assembly for the oven, thereby allowing for lengthwise expansion and contraction of the oven liner. A center flange extending from the front of the oven liner is rigidly secured to a flange extending upwardly from the main base plate assembly such that the front of the oven liner is rigidly suspended above the main base plate the same predetermined distance the rear portion of the bottom wall of the oven liner is suspended above the main base plate. The suspension assembly thus allows for lengthwise, widthwise and heightwise expansion and contraction of the oven liner.

13 Claims, 6 Drawing Figures

OVEN LINER SUSPENSION ASSEMBLY

FIELD OF THE INVENTION

This invention relates to oven liner suspension assemblies, and more particularly relates to a suspension assembly for rigidly suspending an oven liner upon the oven frame assembly while allowing for expansion and contraction of the oven liner undergoing heating and cooling during cooking and self-cleaning operations.

DESCRIPTION OF THE PRIOR ART

The basic structure of a cooking oven includes an oven liner or oven chamber mounted within a cabinet-like structure of frame assembly for the oven. The frame assembly for the oven is often designed to be built into a kitchen wall. Such built-in ovens may include a single oven liner or an arrangement of two oven liners disposed with one on top of another. The oven liner is generally a cubicle-shaped structure having an opening in a front wall which is closed or sealed by an oven door during the cooking operations. In this way, the oven liner retains the heat inside it for preparing the food.

The oven liner used in such ovens is normally constructed of sheet metal which undergoes expansion during the heating cycle and contraction during the cooling cycle when the heating element is turned off. During cooking operations the temperature inside the oven liner typically may range from 300 degrees F. to 450 degrees F., but during the self-cleaning cycle the temperature is much higher, in the range of 875 degrees F. A suspension assembly supporting the oven liner within the cabinet structure should accommodate the relative movement between the oven liner and cabinet structure, particularly the maximum stresses occurring during the self-cleaning cycle. On the other hand, the suspension assembly should at all times rigidly support the oven liner upon the cabinet structure.

Prior art oven suspension assemblies have often proven inadequate in attempting to both rigidly support the oven liner upon the cabinet structure, while at the same time allowing for relevant movement between the oven liner and the cabinet structure. In particular, these prior art oven suspension assemblies are inadequate to handle the stresses on the oven liner during the self-cleaning cycle. If the cabinet structure is repeatedly placed under stress because of the suspension assembly, the enameled finish of the oven liner can be damaged by cracking.

An example of one prior art oven liner suspension assembly is found in U.S. Pat. No. 3,131,684. The suspension assembly disclosed in said patent includes a pair of coiled springs connected between the rear wall of the oven liner and the rear wall of the cabinet structure to accommodate for relevant movement between the two structures in the lengthwise direction. The oven liner is rigidly supported to the cabinet structure by a flange at the front of the oven liner. However, such a suspension assembly does not provide for expansion in the widthwise direction, nor does it provide a rigid vertical support for the oven liner at its rear wall.

An example of another suspension assembly is found in U.S. Pat. No. 3,132,231. This patent discloses an oven liner supported by rollers attached from the side walls of the oven liner and supported within a channel of the side wall of the cabinet structure. Such a suspension assembly provides for lengthwise expansion of the oven liner, but would not provide for free expansion widthwise.

Yet another example of a prior art suspension assembly is found in U.S. Pat. No. 3,385,280. This patent also employs a helical spring in the suspension assembly, where the spring is slightly compressed between the oven chamber and the edge of the oven cavity. Such an arrangement may permit contraction and expansion lengthwise of the oven chamber with any slack being taken up or provided by the spring. Again, there is no disclosure of a rigid vertical support for the oven chamber, except for a hook connecting the rear wall of the oven liner with the rear wall of the cabinet structure.

The oven liner suspension assembly of the present invention overcomes these disadvantages associated with such prior art structures by providing a rigid vertical and horizontal support at the front and rear of the oven chamber, while accommodating the relative motion between the oven liner and cabinet structure occurring during the heating and cooling cycles associated with cooking and self-cleaning operations.

SUMMARY OF THE INVENTION

In accordance with the present invention, an oven liner suspension assembly rigidly supports an oven liner upon the cabinet structure of the oven while allowing for expansion and contraction of the oven liner during operation. A pair of elongated anchor legs is rigidly secured to the rear portion of the oven liner, the anchor legs extending a predetermined distance beyond the bottom wall of the oven liner. The anchor legs have an L-shaped flange base member rigidly attached to a base plate member, such that said anchor leg and said oven liner may bend with respect to the base plate to allow for lengthwise expansion of the oven liner. The base plate member extends beneath the bottom wall of the oven liner and extends to an upwardly extending flange member which is rigidly attached to a flange member extending peripherally from the center region of the front of the oven liner. In this manner, the front of the oven liner is rigidly suspended the same predetermined distance above the base plate member that the rear portion of the oven liner is suspended above the main base plate by the anchor legs.

In accordance with another aspect of the present invention, the flange member extending upwardly from the main base plate terminates in an angle support piece. The flange member extending peripherally from the front of the oven liner extends from the oven liner at a complimentary angle to said angle support piece, such that the front portion of the oven liner is rigidly suspended upon the main base plate.

In accordace with an alternate embodiment of the present invention, an oven liner suspension assembly is provided for rigidly suspending an upper oven liner of a double oven, such that the oven liner may expand and contract with respect to the cabinet structure of the oven. A pair of elongated anchor legs is provided to rigidly secure the rear portion of the oven liner, such that the anchor legs extend beyond the bottom wall of the oven liner and terminate in an L-shaped flange. The L-shaped flange is rigidly supported to a rear support piece attached to the cabinet structure of the oven, such that the oven liner and anchor legs may move relative to the cabinet structure. A front base member extends across the front of the cabinet structure and is rigidly secured thereto. A front support member extends upward from and is rigidly secured to the front base support. The front support member includes a central flange rigidly attached to a flange extending peripherally from the front portion of the oven liner, such that the front portion of the oven liner is rigidly suspended the same predetermined distance the rear portion of the oven liner is suspended above the rear support piece.

BRIEF DESCRIPTION OF THE DRAWINGS

For a more complete understanding of the present invention and further objects and advantages thereof, reference is now made to the following description taken in conjunction with the following drawings.

DESCRIPTION OF THE PREFERRED EMBODIMENT

Figure 1:
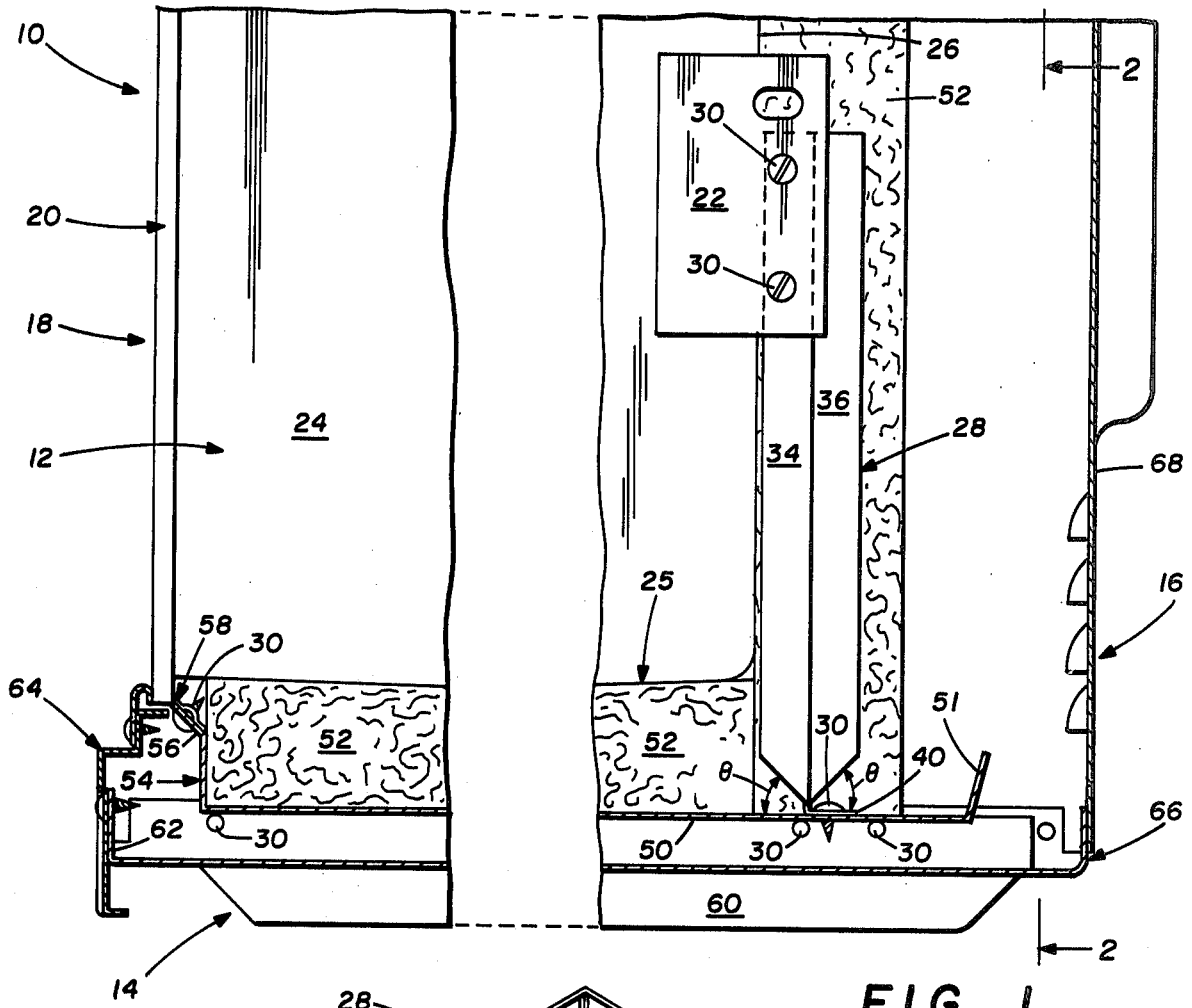
FIG. 1 is a broken-away side elevational view of the oven liner suspension system of the preferred embodiment of the present invention.

FIG. 1 is a broken-away side elevational view of the preferred embodiment of the oven liner suspension assembly of the present invention, generally identified by the reference numeral 10. A generally cubical-shaped oven liner 12 is shown (broken-away to illustrate the suspension assembly 10) rigidly suspended by the oven liner suspension assembly 10 upon the main base frame 14 of the cabinet structure 16. An opening 18 is formed in a vertical front wall 20 of the liner 12. Food is placed in the oven liner 12 through the opening 18, which is then closed and sealed by an oven door (not shown) for retaining heat within the oven liner 12 during cooking or self-cleaning operations.

Figure 5:
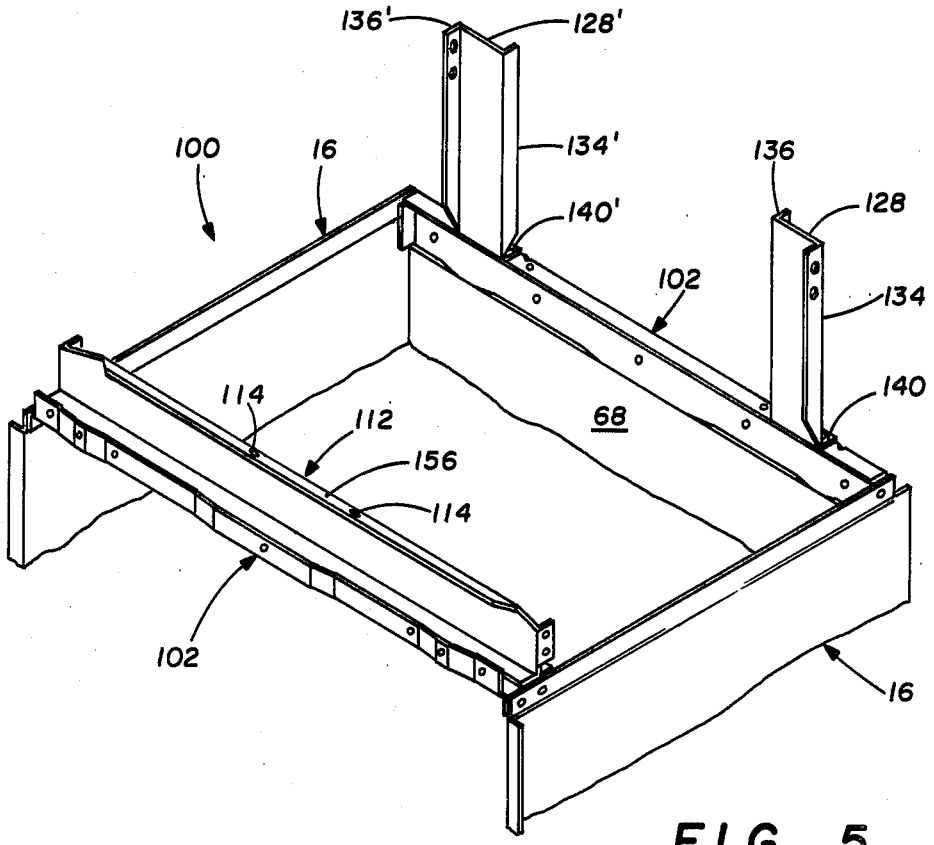
FIG. 5 is a perspective view of an alternate embodiment of the oven liner suspension system of the present invention.

The cabinet structure 16 is a typical frame structure for what is commonly referred to as a built-in oven. The suspension assembly 10, illustrated in FIG. 1, is for an oven liner 12 of a single built-in oven or for a lower oven liner 12 of a built-in double oven. (An oven liner suspension assembly which would be suitable for suspending an upper oven liner 12 of such a built-in double oven is illustrated in FIG. 5 and described further hereinbelow.)

Figure 3:
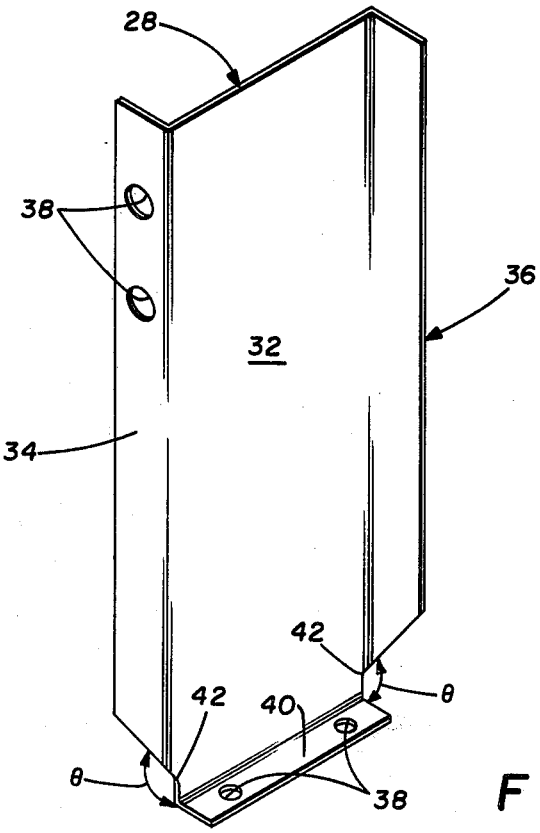
FIG. 3 is a perspective view of a rear anchor plate of the oven liner suspension system.

The oven liner 12 has a rear anchor plate 22 welded to a first side wall 24, the anchor plate 22 being positioned to extend beyond the rear wall 26 of the oven liner 12. A first elongated anchor leg 28 is rigidly secured to the portion of rear anchor plate 22 extending beyond the rear wall 26 by fasteners 30. As illustrated in FIG. 3, the elongated anchor leg 28 includes a central planar section 32 and first and second laterally extending flanges 34 and 36, providing rigidity to the anchor leg 28 as well as a means for attaching the anchor leg 28 to the anchor plate 22. Apertures 38 are provided in the first lateral extending flange 34 for receiving fasteners 30.

The elongated anchor leg 28 extends to a central L-shaped flange 40, which is normal to the central planar section 32. The first and second laterally extending flanges 34 and 36 terminate at a point 42 on the central planar section 32 a predetermined distance above the L-shaped flange 40. The ends of the first and second flanges 34 and 36 are recessed to form a predetermined angle with the flange 40, such that the elongated anchor leg 28 may bend slightly about the flange 40.

The L-shaped flange 40 is rigidly secured to the upper plate 50 of main base frame 14, such that the oven liner 12 is rigidly suspended a predetermined distance above the plate 50. A piece of insulation 52 extends between the bottom wall 25 of the oven liner 12 and the upper plate 50 to reduce the heat loss by the oven liner 12 when the oven is in operation. The upper plate 50 extends beneath the oven liner 12 and terminates below the front wall 20 with an upwardly extending flange 54. The flange 54 extends vertically upward a predetermined distance terminating with an angled support piece 56.

The front wall 20 has a peripherally extending flange 58, where the flange 58 extends from the front wall 20 at an angle complementary to the angle that support piece 56 forms with the flange 54. The peripherally extending flange 58 is thus positioned adjacent the angled support piece 56 and joined thereto by fasteners 30 to rigidly suspend the front wall 20 of the oven liner 12. Thus, the oven liner 12 is rigidly suspended at its front and rear walls such that the bottom wall 25 of liner 12 is suspended a predetermined distance above plate 50.

The upper base plate 50 is secured to the lower base plate 60 in a manner illustrated in FIG. 1 and described further hereinbelow. The lower base plate 60 is disposed directly beneath the upper base plate 50 and terminates in the front with an upwardly extending flange 62 secured to a cover plate assembly, generally illustrated by the reference numeral 64. The rear portion of the lower base plate 60 terminates in an upward extending flange 66 which is attached to a rear frame member 68 comprising part of the cabinet structure 16.

Figure 2:
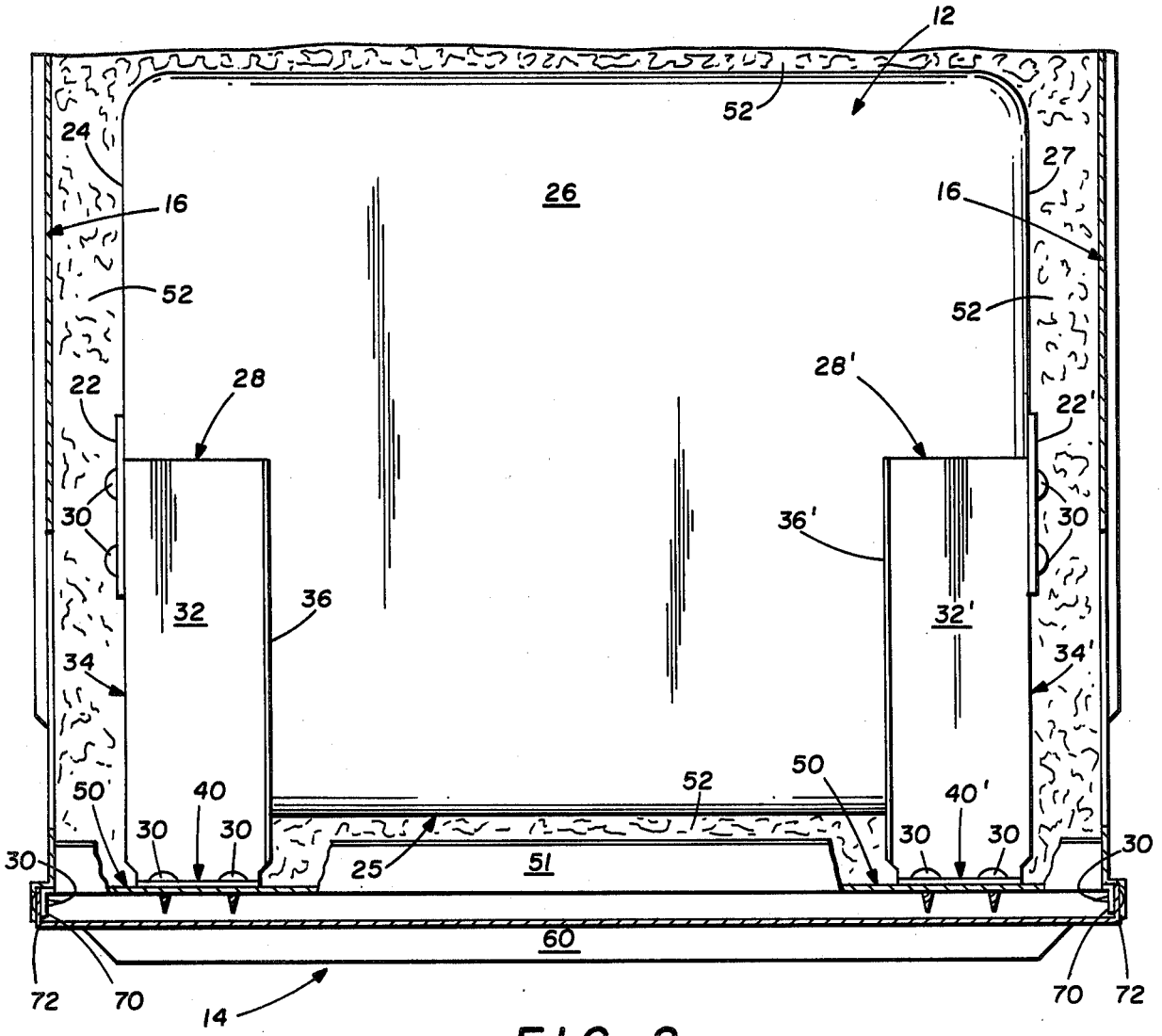
FIG. 2 is a broken-away rear view of the preferred embodiment of the oven liner suspension system of the present invention.

FIG. 2 is a broken-away rear view of the preferred embodiment of the oven liner suspension assembly 10 of the present invention. The first elongated anchor leg 28 is shown attached to the first rear anchor plate 22, which is welded to the side wall 24 of the oven liner 12 in the mid-region of the back wall 26. The second side wall 27 of oven liner 12 has a similar support assembly for rigidly suspending the oven liner 12 to the upper base plate 50. The support assembly for the second side wall 27 is the mirror image of the element supporting the first side wall 24, similar elements being identified by the same reference numerals with the addition of the "′" designation.

The elongated anchor leg 28′ is shown attached to the rear anchor plate 22′, which is welded to the second side wall 27. The elongated anchor leg 28′ extends below the bottom wall 25 of the oven liner 12 and terminates in an L-shaped flange 40′ rigidly secured to the upper base plate 50. Thus, the two elongated rear anchor legs 28 and 28′ rigidly suspend the rear portion of the oven liner 12 a predetermined distance above the upper base plate 50, while providing means for the oven liner 12 to expand and contract during operation.

FIG. 2 also illustrates the upper base plate 50 terminating in laterally extending flanges 70 for securing the upper base plate 50 to the laterally extending flanges 72 of the lower base plate 60.

Figure 4:
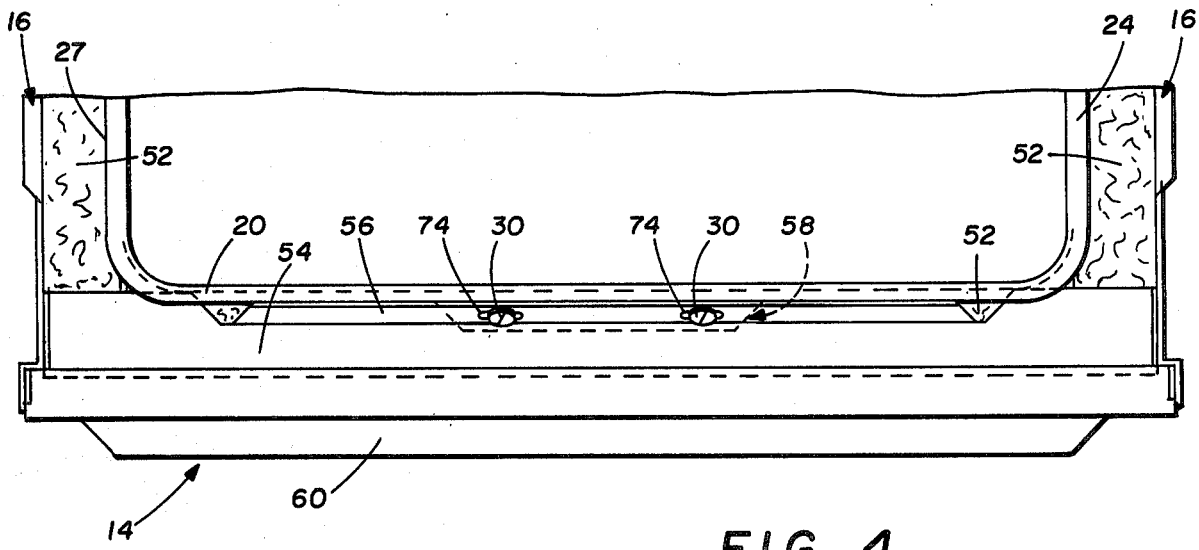
FIG. 4 is a broken-away rear view of the preferred embodiment of the oven liner suspension system of the present invention.

FIG. 4 illustrates a broken-away frontal view of the preferred embodiment of the oven liner suspension assembly 10 of the present invention. The cover plate assembly 64 is not illustrated in order to show more clearly the manner of rigidly supporting the front wall 20 of the oven liner 12. The angled support piece 56 of the upper base plate 50 is shown attached by fasteners 30 to the peripherally extending flange 58 of the front wall 20. The fasteners 30 are received within eliptical openings 74 formed within the flange 58. Thus, by rigidly suspending only the central portion of the front wall 20 of the oven liner 12, the oven liner 12 is rigidly suspended to the upper base plate 50, but allows for relative movement between the oven liner 12 and the main base frame 14 and remaining cabinet structure 16.

In operation, the oven liner 12 is rigidly suspended upon the main base frame 14 by the oven liner suspension assembly 10, and yet the oven liner 12 may expand and contract in all three dimensions with respect to the cabinet structure 16 during cooking operations. The front portion of the oven liner 12 is rigidly secured in the vertical and horizontal plane by the attachment of the peripherally extending flange 58 to the complimentary angled support piece 56 of vertical flange 54. Similarly, the rear portion of the oven liner 12 is supported by the anchor plates 22 and 22' secured near the region of the middle of the height of the rear wall 26, where the anchor plates 22 and 22' are secured to elongated anchor legs 28 and 28'. The central flanges 40 and 40' of the elongated anchor legs 28 and 28' are rigidly secured to the upper base plate 50, such that the front and rear portions of the oven liner 12 are rigidly suspended a predetermined distance above the upper base plate 50.

The L-shaped flanges 40 and 40' of anchor legs 28 and 28' and the attachment of the angled support piece 56 to the peripherally extending flange 58 allows for lengthwise and widthwise expansion and contraction of the oven liner 12 during operation. As the oven liner 12 expands uniformly in the lengthwise direction the anchor legs 28 and 28' may bend slightly about the point where the L-shaped flanges 40 and 40' are rigidly secured to the upper base plate 50. Similarly, the oven liner 12 may expand in the widthwise direction, since the peripherally extending flange 58 is centrally located along the front wall 20 and secured through two elliptical openings 74 of flange 58. Thus, the section of the front wall 20 between the side walls 24 and 27 and the flange 58 have no restriction to expansion in the widthwise direction, and the elliptical openings 74 accommodate the slight widthwise expansion along the central section of the front wall 20.

Finally, the oven liner 12 is free to expand in the third heighthwise dimension in the plane normal to the upper base plate 50, since there is no point along the front wall 20 where the oven liner 12 is restricted to prevent such relative movement. The elongated anchor legs 28 and 28' are attached to the rear portion of the oven liner 12 at a point near the middle of the rear wall 26 and allow for expansion and contraction in the vertical plane of the rear wall 26.

FIG. 5 illustrates an alternate embodiment of an oven liner suspension assembly, generally identified by the reference numeral 100. The oven liner suspension assembly 100 rigidly suspends an oven liner 12 for an upper oven of a built-in double oven. The lower oven of such a built-in double oven could be rigidly suspended by the oven liner suspension assembly 10 previously described. Elements of the oven liner suspension assembly 100 which are similar to the elements previously described for suspension assembly 10 will be identified by the previously referenced numeral increased by 100.

The oven liner 12 suspended by the oven liner suspension assembly 100 is identical to that illustrated in FIG. 1 and described hereinabove. The oven liner 12 is not illustrated in FIG. 5 in order to provide a full perspective view of the suspension assembly 100. It is understood that the upper oven liner 12 is secured to the elements of the suspension assembly 100 in the identical manner shown in FIGS. 1, 2 and 4 and described hereinabove.

Figure 6:
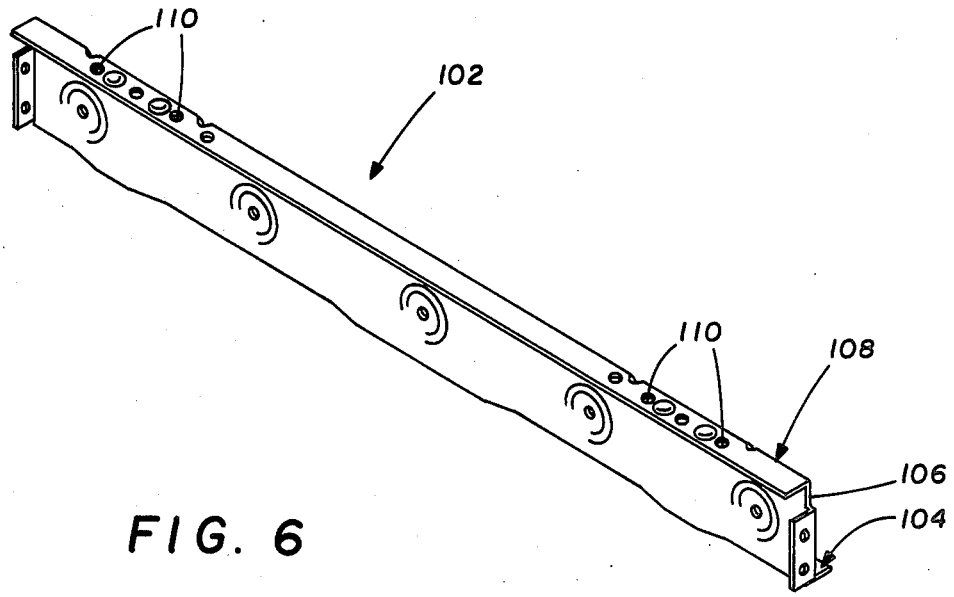
FIG. 6 is a perspective view of a suspension base plate of the alternate embodiment of the oven liner suspension of the present invention.

A rear support piece 102 is rigidly mounted atop the rear frame member 68 of cabinet structure 16. The rear support piece 102, illustrated in FIG. 6, includes a base flange piece 104, an upright vertical piece 106, and an upper flange piece 108. The base flange 104 is rigidly secured to the cabinet structure 16, and the upper flange 108 provides support for the elongated anchor legs 128 and 128'. The anchor legs 128 and 128' are rigidly secured to the upper flange 108 by fasteners 30 (not shown) received within the apertures 110 of the upper flange piece 108. The anchor legs 128 and 128' are thus secured to the rear support piece 102 in a manner similar to the attachment of legs 28 and 28' to upper base plate 50 of suspension assembly 10.

The rear support piece 102 is shown rigidly attached to the front of the cabinet structure 16, the vertical piece 106 being disposed in the horizontal plane for rigidly supporting a front support 112 in the vertical plane. It is to be understood that a support piece other than rear support piece 102 could be utilized to provide a base for front support 112. The front support 112 includes an angled support piece 156 having two openings 114 formed therethrough. The angled support piece 156 is rigidly secured to the peripherally extending flange 58 of an oven liner 12 in the identical manner as illustrated in FIG. 1 for support piece 56 of suspension assembly 10.

The operation of the oven liner suspension assembly 100 is similar to the oven liner suspension assembly 10 in rigidly supporting an upper liner 12 and providing for relative movement between the oven liner 12 and the cabinet structure 16. The elongated anchor legs 128 and 128' are secured to rear anchor plates 22 and 22' of an oven liner 12 identical to the manner in which anchor legs 28 and 28' are secured to plates 22 and 22', as illustrated and described in FIG. 1. The front of the upper oven liner 12 is rigidly secured by the front support 112 to maintain the bottom wall 25 of the oven liner generally in the horizontal plane. The central flanges 140 and 140' cooperate with the upper flange 108 of rear support piece 102 in a manner similar to central flange 40 and upper plate 50. Thus, the elongated anchor legs 128 and 128' rigidly suspend the oven liner 12 and yet provide for the expansion and contraction of the oven liner 12 in the lengthwise and heighthwise dimension. The anchor legs 128 and 128' may bend in either direction about the central flange 140 to accommodate for such expansion and contraction. Similarly, the front support 112 is secured to the center portion of the front wall 20 of the oven liner 12 to rigidly suspend the oven liner 12 and yet provide heightwise and widthwise expansion of the oven liner 12 during operation of the upper oven.

Although preferred embodiments of the invention have been illustrated in accompanying drawings and described in the foregoing description, it will be understood that the invention is not limited to the embodiments disclosed; they are capable of numerous rearrangements, modifications and substitutions of parts and elements without departing from the spirit of the invention.

What is claimed is:

1. An oven liner suspension assembly for rigidly supporting an oven liner within the cabinet structure of an oven while allowing for expansion and contraction of the oven liner during operation, the oven liner being a box-like structure with an open front wall and having a top wall, rear wall, bottom wall and two side walls comprising:

at least one elongated anchor leg rigidly secured to the rear wall of the oven liner, said anchor leg extending a predetermined distance beyond the bottom wall of the oven liner;

a base plate member extending beneath the bottom wall of said oven liner and extending to an upwardly projecting edge;

said anchor leg extending to a flange member, said flange member being rigidly attached to said base plate member such that said anchor a leg may bend with respect to said base plate member during expansion and contraction of the oven liner; and a lip extending peripherally from the front of the oven liner, said lip being rigidly attached to said upwardly projecting edge such that the front of the oven liner is rigidly suspended upon said base plate member such that the oven liner may expand and contract during operation of the oven.

2. The oven liner suspension assembly of claim 1, wherein one of said elongated anchor legs is rigidly secured to each side of the rear wall of the oven liner and said lip extends only from a central region of the front of the oven liner.

3. The oven liner suspension assembly of claim 1, wherein said elongated anchor leg includes flanges extending laterally in opposing directions from a central planar member for providing rigidity to said anchor legs, said laterally extending flanges terminating at a predetermined angle to said flange member to allow for bending of said anchor leg with respect to said base plate member.

4. The oven liner suspension assembly of claim 1, wherein said flange member of said anchor leg is an L-shaped flange member.

5. The oven liner suspension assembly of claim 2 and further comprising:

a pair of anchor plates attached to the rear portion of the oven liner at a predetermined distance from the bottom wall of the oven liner for securing said anchor legs to said oven liner.

6. The oven liner suspension assembly of claim 1, wherein said upwardly projecting edge terminates in an angled support piece and said peripherally extending lip extends from the oven liner at a complementary angle to said angled support piece, such that the front portion of the oven liner is rigidly suspended upon said base plate member.

7. The oven liner suspension assembly of claim 6, wherein said lip extending peripherally from the front of the oven liner and said angled support piece include elliptically shaped apertures formed therein for receiving fasteners, such that the front portion of said oven liner may expand and contract.

8. An oven liner suspension assembly for rigidly suspending an upper oven liner within the cabinet structure of a double oven, the oven liner being a generally cubical shaped structure having an open front and a rear wall, top wall, two side walls and a bottom wall such that the oven liner may expand and contract with respect to the cabinet structure of the oven, comprising:

at least one elongated anchor leg rigidly secured to the rear wall of the oven liner, said anchor leg extending beyond the bottom wall of the oven liner;

a rear support piece rigidly attached to the rear portion of the cabinet structure of the oven;

said anchor leg extending to a base flange member, said base flange member being rigidly attached to said rear support such that said anchor leg may bend with respect to said rear support during expansion and contraction of the upper oven liner;

a front base member extending across the front of the cabinet structure and rigidly secured thereto;

a front support member rigidly secured to said front base member; and a lip extending peripherally from the front portion of the oven liner and rigidly secured to said front support member, such that the front portion of the oven liner is rigidly suspended upon the front support piece such that the stresses upon the cabinet structure are reduced during expansion and contraction of the oven liner.

9. The oven liner suspension assembly of claim 8, wherein one of said elongated anchor legs is rigidly secured to each side of the rear portion of the oven liner and said lip extends from a central region of the front of the oven liner.

10. The oven liner suspension assembly of claim 8, wherein said elongated anchor leg includes flanges extending laterally in opposite directions from a central planar member, said laterally extending flanges terminating at a predetermined angle to said base flange member to allow for bending of said anchor leg with respect to said rear support piece.

11. The oven liner suspension assembly of claim 10 and further comprising:

a pair of anchor plates secured to the rear portion of the upper oven liner at a predetermined distance from the bottom wall of the oven liner for securing said anchor legs to said oven liner.

12. The oven liner suspension assembly of claim 8, wherein said front support member includes an edge formed at an angle to said front support member and said lip extending peripherally from the front wall of the oven liner is formed at an angle complementary to said edge, such that the front portion of the oven liner is rigidly suspended upon said front support member.

13. The oven liner suspension assembly of claim 12, wherein said lip extending peripherally from the front wall of the oven liner and said edge extending from said front support member include elliptically shaped apertures for receiving fasteners, such that the front portion of said oven liner may expand and contract.

* * * * *